US005144301A

United States Patent [19]

Jackson et al.

[11] Patent Number: 5,144,301

[45] Date of Patent: Sep. 1, 1992

[54] SCHOOL BUS LOCATOR SYSTEM

[76] Inventors: Timothy C. Jackson, 3420 Linderwood Dr., Augusta, Ga. 30906; Jeffrey G. Parks, 5214 NW. Rogers La. 406, Lawton, Okla. 73505

[21] Appl. No.: 656,460

[22] Filed: Feb. 19, 1991

[51] Int. Cl.[5] ..... G08G 1/123

[52] U.S. Cl. ..... 340/994; 340/539; 340/989

[58] Field of Search ..... 340/993, 994, 988, 964, 340/661, 691, 384 E, 511, 539

[56] References Cited

U.S. PATENT DOCUMENTS 3,898,514 8/1975 Takahashi ..... 340/384 E
3,927,571 12/1975 Athey ..... 340/691
4,325,057 4/1982 Bishop ..... 340/994
4,713,661 12/1987 Boone et al. ..... 340/994

*Primary Examiner*—Jin F. Ng
*Assistant Examiner*—Christine K. Oda

[57] ABSTRACT

A system for alerting school children that a school bus is moving toward a nearby bus stop, thus prompting the children to leave their residences to reach the bus stop at or before the bus arrives at the stop. The system includes a radio transmitter on the bus and a radio receiver in each home along the bus route. Each receiver has a first warning light that begins to emit a signal when the school bus is a relatively great distance away from the home, and a second sound-emitting speaker that begins to emit an audible signal when the school bus is a relatively short distance away from the home, e.g. one quarter mile.

1 Claim, 1 Drawing Sheet

SCHOOL BUS LOCATOR SYSTEM

BACKGROUND AND SUMMARY OF THE INVENTION

This invention relates to a system for alerting school children and/or their parents of the location of a school bus on a school pick-up (or discharge) route. The system includes a radio receiver in each child's home, whereby radio signals generated by a radio transmitter on a school bus are received at each radio receiver when the receiver is within the range of the transmitter. Signals are received at each radio receiver in time for the students to leave home early enough to meet the bus, but not so soon as to cause unnecessary waiting time or prolonged exposure to weather elements. In the case of small children the system offers a safety feature that limits the time the child has to wait at the bus stop, where he/she might be potentially exposed to abuse from older students or potential child molesters.

The system can be used in the morning hours to alert parents and students when it is necessary to leave home for the appropriate bus stop. The system can also be used in the afternoon hours to alert the parent when the student will be leaving the bus at the appropriate bus stop; the parent can then drive to the bus stop or look for the child's arrival, depending on the distance between the bus stop and the residence.

U.S. Pat. No. 4,713,661 to J. Boone et al discloses a school bus alerting system in which each bus driver announces his/her arrival at a particular bus stop. Each home radio receiver includes a microprocessor that decodes the received message and determines whether the message is coming from the appropriate bus, i.e. the bus that is on the particular route passing by that specific home. A speech synthesizer is connected to each microprocessor to deliver the message through a speaker. The system is apparently designed for use in congested areas where multiple buses might at different times be in close geographical proximity to particular residences without being on the particular route for the particular residence. The microprocessor apparently screens out signals coming form the busses that are not scheduled to pick up children living at the particular residence.

The system of U.S. Pat. No. 4,713,661 is believed to have some disadvantages. For example, the system won't be effective if the bus driver neglects or refuses to announce each stop (or at least most of the stops). Also, the system apparently requires the bus driver to use specific appropriate terminology (otherwise the home receiver microprocessor may not be able to decode the message). The system is probably not usable by temporary bus drivers who are not completely familiar with the microprocessor system or the proper word identification for each bus stop.

The present invention is directed to a relatively simple low cost alternative to the system shown in U.S. Pat. No. 4,713,661.

The proposed system comprises radio transmitter on the bus and individual radio receivers locatable in residences along particular bus routes. Each receiver picks up a signal as the receiver comes into the transmitter broadcast range. Each receiver has associated therewith a light-emitting diode for alerting the parents and students when the bus is a particular distance from the residence, e.g. three quarters mile away. One or two audio speakers are associated with each receiver to generate audible signals (e.g. beeper signals) when the bus is closer to the residence, e.g. one quarter mile away.

The system provides an advance warning signal (by the light emitting diode) and one or two final warning signal(s). In those situations where two or more school busses may be travelling through the same neighborhood, the respective busses and receivers may be set to different signal frequencies, such that each home receiver responds only to the signal frequency coming from the appropriate bus. The system is somewhat similar to garage door opener systems (but with greater operating ranges). The system is intended to be automatic in nature; the bus driver does not have to make any announcements or operate specific control devices.

THE DRAWINGS

DESCRIPTION OF A PREFERRED EMBODIMENT OF THE INVENTION

Figure 1:
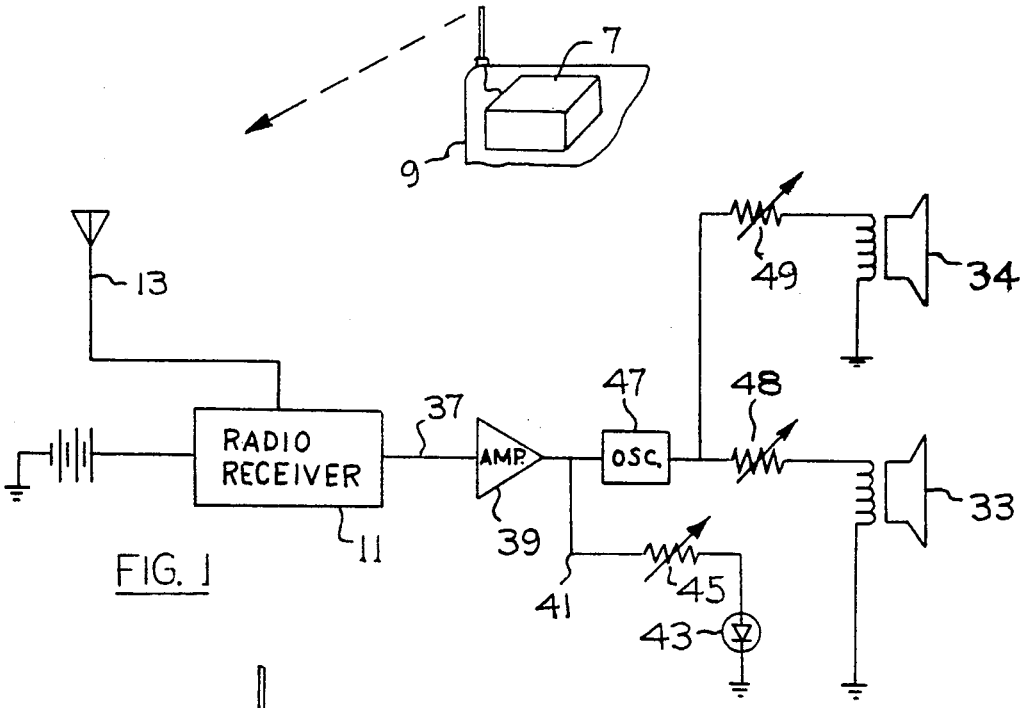
FIG. 1 is a schematic drawing of an electrical system that can be used in practice of the invention.
Figure 2:
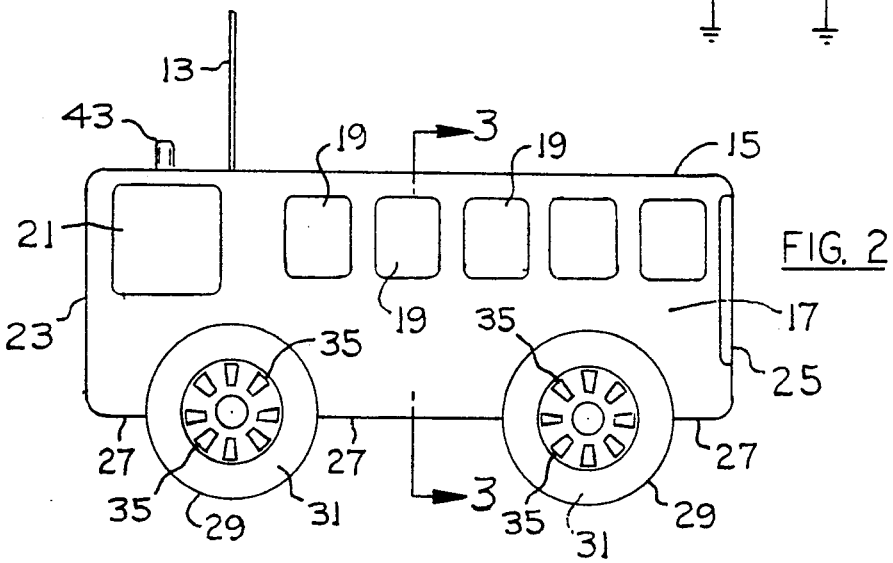
FIG. 2 is an external elevational view of a home receiver usable to contain the FIG. 1 circuitry.
Figure 3:
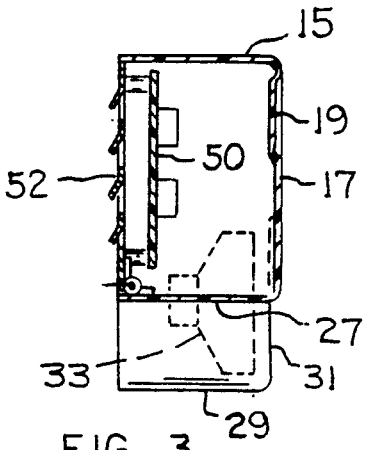
FIG. 3 is sectional view taken on line 3—3 in FIG. 2.

The drawings show a home radio receiver 11 having an electrical connection to a receiving antenna 13.

Each home in the system will have a radio receiver of the type shown in the drawings. The school bus 9 will be equipped with a radio transmitter 7 tuned to the same frequency as the home receivers. The effective broadcast range of the transmitter will be limited to a distance of approximately two miles. As the bus travels along its route different home receivers will be brought into the range of the transmitter. Each home receiver has an advance warning light 43 that generates an early warning signal when the bus is still some distance away from the home, e.g. one mile. Each home receiver also has at least one sound broadcast speaker 33 or 34 that begins to broadcast a beeper warning signal when the bus is nearer to the home, e.g. one quarter mile away. The beeper warning signal serves as a final alert that the student has to leave for the bus stop immediately or he/she may possibly miss the bus.

The threshold distances at which the warning devices 43 and 33 and 34 begin to emit warning signals are variable (adjustable) to meet individual circumstances, e.g. different travel times from the home to the bus stop, or individual thoughts as to how much time is necessary to reach the bus stop.

Each home receiver apparatus will be housed within a hollow housing 15 constructed to simulate a miniature school bus. Front wall 17 of the housing has a series of inset areas 19 that simulate the side windows of the school bus. A somewhat larger inset area 21 simulates a side window alongside the driver's seat of the bus. End wall 23 of the housing simulates the front end of the bus; end wall 25 of the housing simulates the rear end of the bus. Silhouettes of children and a uniformed bus driver can be painted on the simulated windows 19 and 21.

The bottom wall of housing 15 includes horizontal flat sections 27 simulating the undersurface of the bus, and two spaced semi-circular sections 29 simulating lower surface areas of the bus road wheels. The radio receiver housing can be placed on a shelf or table surface, with semi-circular sections 29 resting on the support surface. The housing is open along its rear face for insertion of the electrical apparatus into the housing interior space. The electrical system shown in FIG. 1 is placed within the housing.

Each simulated road wheel includes a circular wall section 31 inset slightly from front wall 17 of the radio receiver housing. An audio speaker 33 or 34 is located behind each circular wall section 31 within the cavity defined by the associated semi-circular wall section 29. A series of radial openings 35 is formed in each circular wall section 31 to simulate wheel spoke openings. Each speaker 33 is oriented to direct its audible output through the associated radial openings 35 and out into the room.

Referring to FIG. 1, receiver 11 has an electrical output line 37 connected to an amplifier 39. The signal received by antenna 13 is translated into a small steady state current in line 37. The receiver will be constructed to deliver a usable signal through line 37 when a radio transmitter (of the same frequency) on the school bus is within a predetermined distance away from the home receiver, e.g. one mile or less from the receiver. Amplifier 39 delivers an amplified signal through line 41 to a light-emitting diode 43; an adjustable resistance 45 adjusts the current value so that diode 43 begins to emit a visible signal when the school bus is a predetermined distance away, e.g. three quarter mile. Manual adjustment of resistance 45 can be used to vary the threshold distance at which diode 43 begins to emit a light signal. The light-emitting diode will be located in a conspicuous location on the simulated bus, e.g. on the roof of the bus or behind the driver's side window 21 (in which case window 21 will be transparent or translucent).

An audio oscillator 47 is connected to the output of amplifier 39 to generate oscillating signals for us by speakers 33 or 34. A manually adjustable resistance 49 is associated with each speaker for varying (or controlling) the oscillating current signals; adjustable resistances 48 or 49 can be selectively (individually) adjusted to establish different threshold signal values at which each individual speaker begins to broadcast an audible signal. The audible signals can be beeper signals, i,e, shrill low level whistle signals readily detectable by an average person (child or adult).

The audible signals broadcast by speakers 33 will begin to exist at a later point in time than the light signal generated by diode 43. Thus, resistances 45, 48, 49 can be adjusted so that diode 43 begins to generate a signal when the school bus is relatively far away from the home receiver, e.g. one mile. One of the speakers can be set to begin to broadcast a beeper signal when the bus is somewhat closer, e.g. one half mile away. The other speaker can be set to begin to broadcast when the bus is still closer, e.g. one quarter mile away.

The signalling system will provide an early warning of the thus probable arrival time at the appropriate bus stop, (i.e. the nearest bus stop) and at least one final warning of the arrival time. Diode 43 provides an early warning signal. Speakers 33 provide the final warning. The signals are of a different character (visible versus audible), such that the parent or child can readily distinguish the early warning signal from the final warning signal. The final warning signal by the two speakers 33 can have a higher intensity than the intermediate signal provided by only one of the speakers.

There may be situations where different school buses travel through the same neighborhood. A preferred system should preferably prevent the home receivers from mistakenly broadcasting warning signals responsive to electromagnetic signals received from the wrong bus (or buses). Such mistakes can be prevented by having each school bus in the system transmit a different frequency signal. Home receivers on the route for a particular bus will be tuned to receive only that particular frequency.

The system is believed to be a low cost alternative to the system disclosed in aforementioned U.S. Pat. No. 4,713,661. In preferred practice of the invention each home receiver will have its housing configured to simulate a miniature school bus. This will remind the parent or child of the purpose for the radio receiver, thereby stimulating the child to hasten his/her efforts at timely meeting the bus.

The electrical apparatus constituting each radio receiver can be mounted in the receiver housing in various different ways. As previously noted, each speaker 33 or 34 is preferably mounted behind one of the simulated road wheel walls 31 to broadcast its beeper signal through the wheel spoke openings 35. The cooperating electrical components can be mounted on a circuit board 50 that is carried on a hinged cover 52 that closes the rear open area of housing 15.

The drawings necessarily show one particular construction. However it will be appreciated that the invention may be practiced in various different structural configurations.

We claim:

1. A school bus locator system comprising a radio transmitter in a remote on-the-road school bus; an individual radio receiver in each of the homes of school children; said radio receiver being operable to generate an electric signal when the remote school bus is within a predetermined distance of said radio receiver;

a light emitting diode associated with said radio receiver to be energized to emit a light signal thereby when the remote bus is a predetermined geographical distance from said radio receiver;

an oscillator associated with said radio receiver in electrical parallelism with the light-emitting diode for generating audible beeper signals separate from the emitted light signal; two separate speakers connected to said oscillator in electrical parallelism with each other for broadcasting separate beeper signals;

three separate adjustable resistance means connected to the light emitting diode and each of the two speakers to determine the minimum geographical spacing between the remote school bus and the radio receiver required for the light emitting diode to be energized and for the respective speakers to begin broadcasting;

a housing for said radio receiver, light-emitting diode oscillator, the separate speakers and said three separate adjustable resistance means; the housing simulating the appearance of a miniature school bus;

the housing including a front wall and a bottom wall, said bottom wall comprising horizontal flat sections (27) simulating the undersurface of the miniature bus, and two spaced semi-circular sections (29) simulating lower surface areas of the miniature bus road wheels; said housing front wall having two inset circular wall sections (31) simulating side surface areas of the miniature bus road wheels;

each of said speakers being located within the housing behind each of the two inset circular wall sections that form the simulated road wheels; each said inset circular wall sections having a series of radial openings extending therethrough to simulate wheel spoke openings; each of said speakers being oriented so that its beeper signal is directed through the associated spoke openings.

* * * * *